US011185762B2

(12) United States Patent
Jackson

(10) Patent No.: US 11,185,762 B2
(45) Date of Patent: Nov. 30, 2021

(54) TICTACTOE-LIKE INSTANT GAME TICKET

(71) Applicant: Kathleen Nylund Jackson, Newport, NC (US)

(72) Inventor: Kathleen Nylund Jackson, Newport, NC (US)

( * ) Notice: Subject to any disclaimer, the term of this patent is extended or adjusted under 35 U.S.C. 154(b) by 0 days.

(21) Appl. No.: 17/108,198

(22) Filed: Dec. 1, 2020

(65) Prior Publication Data

US 2021/0077898 A1 Mar. 18, 2021

Related U.S. Application Data

(60) Provisional application No. 62/947,120, filed on Dec. 12, 2019.

(51) Int. Cl.
*A63F 3/06* (2006.01)
*G07F 17/32* (2006.01)

(52) U.S. Cl.
CPC ..... *A63F 3/0665* (2013.01); *A63F 3/069* (2013.01); *A63F 3/0645* (2013.01); *A63F 3/0685* (2013.01); *A63F 2003/067* (2013.01); *A63F 2003/0675* (2013.01); *G07F 17/329* (2013.01)

(58) Field of Classification Search
CPC ..... G07F 17/329; A63F 3/0665; A63F 2003/067; A63F 2003/0675; A63F 3/0645; A63F 3/069; A63F 3/0685
USPC ..... 273/139
See application file for complete search history.

(56) References Cited

U.S. PATENT DOCUMENTS 5,002,313 A 3/1991 Salvatore
5,046,737 A 9/1991 Feinberg
5,074,566 A 12/1991 Desbiens
5,092,598 A 3/1992 Kamille
5,118,100 A 6/1992 Gremina
5,158,293 A 10/1992 Mullins
5,193,815 A * 3/1993 Pollard ..... A63F 3/062 273/139
5,407,200 A 4/1995 Zalabak
5,494,317 A 2/1996 Johnson
5,560,608 A * 10/1996 Silverschotz ..... A63F 3/0665 273/240
5,560,610 A * 10/1996 Behm ..... A63F 3/062 273/139
5,657,991 A * 8/1997 Camarato ..... A63F 3/0665 273/269
5,743,524 A 4/1998 Nannicola
5,782,470 A * 7/1998 Langan ..... A63F 3/00028 273/139
5,909,875 A 6/1999 Weingardt
5,934,671 A 8/1999 Harrison
6,241,246 B1 6/2001 Guttin et al.
6,250,685 B1 6/2001 Walker et al.
6,588,747 B1 7/2003 Seelig
6,612,576 B1 9/2003 Stancik et al.
6,698,755 B2 3/2004 Cherry
6,761,633 B2 7/2004 Riendeau et al.
6,889,978 B2 5/2005 Schaefer et al.
(Continued)

*Primary Examiner* — Benjamin Layno

(57) ABSTRACT

A method of playing a lottery instant scratch ticket game comprises a plurality of scratch tickets, wherein each ticket comprises four game grids. Each ticket provides a TicTac-Toe-like gameplay and wherein "O" symbols provide a payout differing from "X" symbols in each separate game grid. A mini jackpot and a maxi jackpot may be provided. Alternate embodiments are discussed.

20 Claims, 5 Drawing Sheets

(56) References Cited

U.S. PATENT DOCUMENTS

| | | | | |
|---|---|---|---|---|
| 6,918,589 | B2 | 7/2005 | Thibault | |
| 6,926,273 | B1 | 8/2005 | Vancura | |
| 7,004,506 | B2 | 2/2006 | Downes et al. | |
| 7,396,015 | B2 | 7/2008 | Feola | |
| 7,410,168 | B2 | 8/2008 | Gumina | |
| 7,429,044 | B2 | 9/2008 | O'Brien | |
| 7,458,580 | B2 * | 12/2008 | Martineck | A63F 3/0415 273/139 |
| 7,481,432 | B2 | 1/2009 | Feola | |
| 7,497,778 | B2 | 3/2009 | Bozeman | |
| 7,510,116 | B2 | 3/2009 | Robb et al. | |
| 7,530,570 | B2 | 5/2009 | Nulph et al. | |
| 7,959,188 | B2 | 6/2011 | Martineck | |
| 7,980,559 | B2 | 7/2011 | Miller et al. | |
| 8,231,449 | B2 | 7/2012 | Martineck, Sr. | |
| 8,262,461 | B2 | 9/2012 | Frick | |
| 8,298,063 | B2 | 10/2012 | Packes et al. | |
| 8,333,380 | B2 | 12/2012 | Berkowitz | |
| 8,512,123 | B2 | 8/2013 | Stanek et al. | |
| 8,523,078 | B2 | 9/2013 | Biskupski | |
| 8,579,693 | B2 | 11/2013 | Bennett, III et al. | |
| 8,628,082 | B2 | 1/2014 | Martineck | |
| 8,672,325 | B2 | 3/2014 | Green | |
| 8,864,565 | B2 | 10/2014 | Packes et al. | |
| 10,130,868 | B2 | 11/2018 | Jackson | |
| 2002/0130464 | A1 | 9/2002 | Taylor et al. | |
| 2005/0148379 | A1 | 7/2005 | Huard et al. | |
| 2006/0252488 | A1 | 11/2006 | LaLonde et al. | |
| 2006/0287055 | A1 | 12/2006 | Hamud | |
| 2007/0021186 | A1 | 1/2007 | Hamud | |
| 2007/0187888 | A1 * | 8/2007 | Dures | A63F 3/0665 273/138.1 |
| 2009/0098922 | A1 | 4/2009 | Cummings et al. | |
| 2009/0253481 | A1 | 10/2009 | Honour | |
| 2010/0144417 | A1 | 6/2010 | Wright et al. | |
| 2011/0281637 | A1 | 11/2011 | Meyer et al. | |
| 2012/0289302 | A1 | 11/2012 | Martinez | |
| 2013/0324212 | A1 | 12/2013 | Frick et al. | |
| 2014/0246849 | A1 * | 9/2014 | Frost | A63F 3/0665 283/101 |
| 2014/0274275 | A1 | 9/2014 | DeFrance et al. | |
| 2014/0375045 | A1 | 12/2014 | Jackson | |
| 2015/0115593 | A1 | 4/2015 | Jackson | |
| 2019/0371115 | A1 | 12/2019 | Jackson | |
| 2020/0054935 | A1 | 2/2020 | Jackson | |
| 2020/0078663 | A1 | 3/2020 | Jackson | |

* cited by examiner

TICTACTOE-LIKE INSTANT GAME TICKET

RELATED APPLICATION DATA

This application claims priority from U.S. Provisional Patent Application Ser. No. 62/947,120 filed Dec. 12, 2019, and having the Title TICTACTOE-LIKE INSTANT GAME TICKET.

BACKGROUND OF THE INVENTION

1. Field of the Invention

The present invention relates to an instant game ticket (otherwise known in the art as a "scratch ticket"). The invention further relates to lottery gaming wherein the physical instant game ticket may be purchased and verified at a lottery agent location or other suitable locations, the ticket utilizing a tic-tac-toe gameplay that provides differing payouts for X symbols and O symbols, and differing payouts for separate quadrants. An electronic version is also discussed.

2. Background of the Art

For over 50 years, instant game tickets, or scratch tickets as in known in the art, have been offered for sale as part of city, state, and national lotteries. These tickets typically have an array of winning numbers and an array of player numbers, each concealed with a removable film. The player scratches off the film to reveal the numbers. If a player number matches a winning number, a prize is won.

Scratch ticket games are provided wherein a predetermined number of tickets are printed, each ticket providing either a losing result or a winning result. The amount of tickets with losing results is predetermined, as are the number of tickets with winning results. Also predetermined is the number of tickets for each individual win amount. The total amount of awards of the winning tickets will be less than the total cost of all tickets in the game. For instance, a total of 90,720,000 $5 tickets may be printed and sold. The total ticket sales will be $453,600,000. The total payout to players may be $345,471,000.

Scratch tickets (otherwise known as instant tickets or scratchers) have gained considerable popularity since they provide a near instant gratification; that is, the result can be determined in mere seconds. Traditional scratch tickets provide winning numbers and player numbers, wherein a match between a winning number and a player number provides a prize.

In order to keep the gameplay fresh and appealing, new versions of the instant ticket have been created. Various attempts have been made to create new instant games and gameplay in order to increase player participation and excitement.

U.S. Pat. No. 8,512,123 (Stanek, et al.) teaches a method and associated lottery game card/ticket for implementing a ticket-based, multi-component lottery game and includes providing lottery tickets for players, wherein the lottery tickets include a first game component with a first prize structure and at least one additional game component with a separate second prize structure. A first validation code is provided on the lottery ticket that is linked to a first game server for validating and redeeming the first game component of the lottery ticket. A second validation code is provided on the lottery ticket that may be linked to a separate second game server for validating and redeeming the second game component of the lottery ticket. Validation and redemption of the lottery ticket for the first and second game components is enabled by separate redemption acts.

United States Patent Publication No. 20140246849 (Frost) discloses a scratch off lottery ticket apparatus comprising a first side and a second side, said first side comprising a plurality of prize amounts or symbols, said plurality of prize amounts or symbols positioned to create two or more individual game play areas, said individual game play areas positioned to create an entire game play area, said first side further comprising an opaque scratch off material layer, such that said plurality of prize amounts or symbols cannot be determined through the scratch off material layer, whereby upon removing some or all of the scratch off material layer, each of the two or more individual game play areas may reveal a first winning combination of similar prize amounts or symbols, and whereby upon removing some or all of the scratch off material layer, said entire game play area may reveal a second winning combination of similar prize amounts or symbols.

United States Patent Publication No. 20020130464 (Taylor, et al.) teaches a lottery ticket as well as a lottery game and method of playing that game using the lottery ticket. The lottery ticket can be used to participate in at least one of a plurality of drawing events that occur over a period of time. The lottery ticket comprises a number of panels that conceal a number of playing game pieces and/or free spaces. The playing game pieces and/or free spaces are concealed by a removable coating material. Participants can choose which drawing event to play, manifesting their intent to play a particular drawing event by revealing the playing game pieces associated with the panels that are designated specifically for that particular drawing event. The game is played further by selecting a combination of winning game pieces and determining whether any of each participant's playing game pieces match some or all of the winning game pieces. A ticket becomes a winning ticket if some or all of the matching playing game pieces on the lottery ticket adjoin so as to produce a winning line of a horizontal, vertical or diagonal "three-in-a-row" as with tic-tac-toe. More than one winning line is possible on each lottery ticket, producing multiple ways of winning on a single lottery ticket.

Each of the references discussed in this text art are incorporated herein in their entirety for all purposes.

It is an ever-increasing challenge to provide players with new and enticing gameplay features that will stimulate player interest and increase participation in instant lottery games. Extended-play tickets have been introduced to the lottery market, appealing to players that prefer a longer play method. Unfortunately, some of these longer-playing tickets incorporate confusing or difficult gameplay. The present invention provides a simple, easy-to-understand play method while still providing excitement and increased anticipation.

SUMMARY OF THE INVENTION

The present invention discloses an instant lottery ticket and method of conducting a lottery instant scratch ticket game that provides a plurality of physical scratch tickets, wherein four (preferably color-coded) game grids are provided for each ticket, each game grid preferably comprising nine play spaces formed by a three-column by three-row format. Jackpot spaces comprise at least one play space in each game grid. "X"s and "O"s are provided as play symbols, and are distributed within the play spaces in each game grid. The value of an "X" symbol differs from the value of an "O" symbol in any one specific game grid. Each play space is concealed by an opaque removable film that is marked by a marking symbol from a predetermined set of unique marking symbols. An array of player symbols from the predetermined set of marking symbols is provided and concealed by an opaque removable film. The player symbols are revealed by removing the opaque film. Each marking symbol that matches a player symbol is removed to reveal a play symbol. If like revealed play symbols are aligned horizontally, vertically or diagonally to comprise at least one entire column, row or diagonal line in any of the game grids, a prize is awarded according to a predetermined paytable. If like play symbols are revealed in all of the jackpot spaces, a jackpot prize is awarded according to the predetermined paytable. Additional embodiments are disclosed herein.

DETAILED DESCRIPTION OF THE INVENTION

Figure 1A:
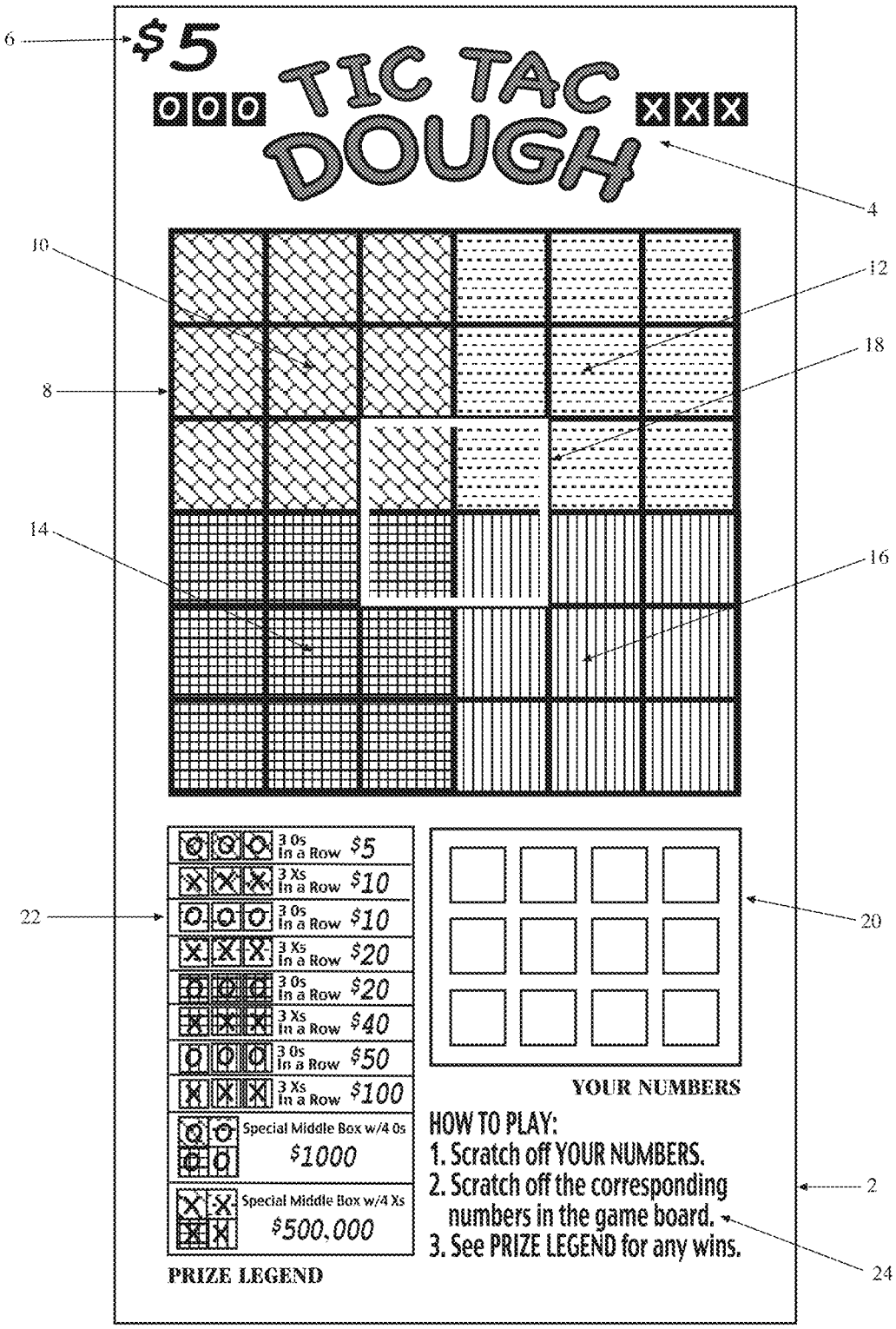
FIG. 1A shows the base card of an instant scratch ticket containing the game elements for a game utilizing the game technology described in a first preferred embodiment of the present invention herein.

A first preferred embodiment of the present invention describes an instant lottery ticket and method of conducting a lottery instant scratch ticket game comprising: a) providing a plurality of physical scratch tickets; b) providing at least two game grids on each ticket, each game grid comprising a predetermined amount of columns and the same predetermined amount of rows; c) designating each area of each game grid formed by the intersection of a column and a row as a play space; d) designating at least one play space of each game grid as jackpot space(s), wherein the jackpot space(s) in any one game grid cannot by themselves constitute a win and wherein all of the jackpot spaces collectively may determine a win; e) providing a predetermined set of play symbols comprising at least two distinct symbols having differing values in any one specific game grid; f) distributing an array of play symbols in the play spaces in each game grid; g) concealing each play space with an opaque removable film; h) providing a unique marking symbol from a predetermined set of unique marking symbols associated with each of the play spaces; i) providing an array of player symbols from the predetermined set of unique marking symbols; j) concealing each player symbol with an opaque removable film; k) revealing each player symbol by removing the opaque film concealing the player symbols; l) removing the opaque film over each play space that is associated with each marking symbol that matches a player symbol to reveal a play symbol; m) determining if like revealed play symbols are aligned horizontally, vertically or diagonally to comprise at least one entire column, row and/or diagonal line in any of the game grids; n) determining if like play symbols are revealed in all of the jackpot spaces; o) providing a predetermined paytable based on each entire column and/or row that reveals like play symbols and its associated game grid; p) providing a predetermined paytable based on like play symbols that are revealed in all of the jackpot spaces; and q) providing any prizes according to the predetermined paytables.

The said first preferred embodiment of the present invention discloses a lottery game in which a plurality of instant scratch tickets is provided. A wager of cash, credits or non-monetary points may be required to play the game. The name of the game is shown on each ticket. Preferably, a printed verification code is provided and is concealed underneath an opaque film. The said verification code provides an encryption that guarantees that the ticket is valid and maintains the authenticity of the instant game ticket. The price of the ticket is provided, as well as instructions and a predetermined paytable. Each ticket preferably comprises four game grids, each game grid comprising a predetermined X amount of columns and a predetermined Y amount of rows providing an X times Y amount of play spaces. Preferably nine play spaces are provided by a three-column by three-row format. Each game grid is preferably differentiated by a color as described hereto, although patterns, icons, or the like may be utilized. The game grids are adjoined in a 2×2 format, wherein the top left game grid is designated as a first game grid, the top right game grid is designated as a second game grid, the bottom left game grid is designated as a third game grid, and the bottom right game grid is designated as a fourth game grid. As an example, the play spaces in the first game grid may be colored yellow, the play spaces in the second game grid may be blue, the play spaces in the third game grid may be green, and the play spaces in the fourth game grid may be red. At least one play space of each game grid is designated as a jackpot space. Preferably the lower right play space in the first game grid, the lower left play space in the second game grid, the upper right play space in the third game grid, and the upper left play space in the fourth game grid comprise jackpot spaces ("jackpot area"). In other words, the jackpot area is a centrally-disposed square containing four different-colored play spaces. It is preferred that the jackpot area is specially marked (by a white outline square, for instance) to highlight the said jackpot area. At least two different symbols, preferably "X" symbols and "O" symbols, are provided as play symbols, and are distributed within the play spaces in each game grid. The value of an "X" symbol preferably differs from, and preferably is greater than, the value of an "O" symbol in any one specific game grid. Each play space is concealed by an opaque removable film that is marked by a unique marking symbol from a predetermined set of unique marking symbols. An array of player symbols from the predetermined set of unique marking symbols is provided and concealed by an opaque removable film. The player symbols are revealed by removing the opaque film concealing the player symbols. The opaque removable film comprising any unique marking symbol that matches a player symbol is removed to reveal a play symbol. If like revealed play symbols are aligned horizontally, vertically or diagonally to comprise at least one entire column, row or diagonal line in any one of the game grids, a prize may be awarded according to the predetermined paytable. It should be noted that prizes for three-in-a row are based on the particular play symbol and the particular game grid. For instance, three "X" symbols in a row in a game grid may produce a higher prize than three "O" symbols in a row in the same said game grid. "X-X-X" may pay $10 and "O-O-O" may pay $5 in the first (yellow) game grid. Additionally, for instance, three "O" symbols in a row in the fourth (red) game grid may produce a higher prize ($100, for instance) than three "X" symbols in a row in the second (blue) game grid ($20, for instance). If all of the jackpot spaces are revealed and comprise like play symbols, a jackpot prize may be awarded. For instance, if all "O" symbols are revealed in all of the jackpot spaces, a mini jackpot prize may be awarded according to the predetermined paytable. If all "X" symbols are revealed in all of the jackpot spaces, a maxi jackpot prize may be awarded according to the predetermined paytable. Any prize-winning ticket (according to a verification code) is then reverified by processing the ticket through a computer terminal comprised of at least a ticket input device and a computer processor at a lottery agent location or other suitable locations.

A second preferred embodiment of the present invention describes an instant lottery ticket and method of conducting a lottery instant scratch ticket game comprising: a) providing a plurality of physical scratch tickets; b) providing at least two game grids on each ticket, each game grid comprising a predetermined amount of columns and a differing predetermined amount of rows; c) designating each area of each game grid formed by the intersection of a column and a row as a play space; d) designating at least one play space of each game grid as jackpot space(s), wherein the jackpot space(s) in any one game grid cannot by themselves constitute a win and wherein all of the jackpot spaces collectively may determine a win; e) providing all of the play spaces in each separate game grid with like play symbols from a predetermined set of play symbols, wherein the play symbols for each separate grid differ from one another; f) covering each play space with a removable film; g) providing a unique marking symbol from a predetermined set of marking symbols for each of the play spaces; h) providing an array of marking symbols from the predetermined set of marking symbols as player symbols; i) concealing each player symbol with an opaque removable film; j) revealing each player symbol by removing the opaque film concealing the player symbols; k) removing the removable film over each play space comprising each marking symbol that matches a player symbol to reveal a play symbol; l) determining if like said revealed play symbols are aligned horizontally or vertically to comprise at least one entire column and/or row in any of the game grids; m) determining if said play symbols are revealed in all of the jackpot spaces; n) providing a first predetermined paytable based on each entire column and/or row comprising revealed play symbols and its associated game grid; o) providing a second predetermined paytable based on revealing play symbols in all of the jackpot spaces; and p) providing any prizes according to the predetermined paytables.

The said second preferred embodiment of the present invention discloses a lottery game in which a plurality of instant scratch tickets is provided. A wager of cash, credits or non-monetary points may be required to play the game. The name of the game is shown on each ticket. Preferably, a printed verification code is provided and is concealed underneath an opaque film. The said verification code provides an encryption that guarantees that the ticket is valid and maintains the authenticity of the instant game ticket. The price of the ticket is provided, as well as instructions and a predetermined paytable. Each ticket preferably comprises four game grids, each game grid comprising a predetermined X amount of columns and a predetermined Y amount of rows providing an X times Y amount of play spaces. Preferably twelve play spaces are provided by a three-column by four-row format. All of the play spaces in each separate game grid are provided with like play symbols from a predetermined set of play symbols (for example, colors, patterns, icons, etc), wherein the play symbols for each separate grid differ from one another. In other words, the play spaces in each different game grid may comprise a different color: the play spaces in a first grid may be yellow, the play spaces in a second grid may be red, the play spaces in a third grid may be green, and the play spaces in a fourth grid may be blue. The game grids are adjoined in a 2×2 format, wherein the top left game grid is designated as a first game grid, the top right game grid is designated as a second game grid, the bottom left game grid is designated as a third game grid, and the bottom right game grid is designated as a fourth game grid. At least one play space of each game grid is designated as a jackpot space. Preferably the lower right play space in the first game grid, the lower left play space in the second game grid, the upper right play space in the third game grid, and the upper left play space in the fourth game grid comprise jackpot spaces ("jackpot area"). In other words, the jackpot area is a centrally-disposed square containing four different-colored play spaces. It is preferred that the jackpot area is specially marked (by a white outline square, for instance) to highlight the said jackpot area. Each play space is concealed by a removable film that is marked by a unique marking symbol from a predetermined set of unique marking symbols. The marking symbols may be disposed within the play spaces and covered with a transparent removable film, or the marking symbols may be disposed on the transparent removable film. An array of player symbols from the predetermined set of unique marking symbols is provided and concealed by an opaque removable film. The player symbols are revealed by removing the opaque film concealing the player symbols. The removable film comprising any unique marking symbol that matches a player symbol is removed to reveal a play space. If the revealed play spaces are aligned horizontally or vertically to comprise at least one entire column and/or row in any of the game grids (herein described as contiguous play spaces), a prize may be awarded according to the predetermined paytable. It should be noted that prizes are awarded for the amount of play spaces within the contiguous play spaces and the particular game grid. For instance, four contiguous play spaces in a game grid may produce a higher prize than three contiguous play spaces in the same said game grid. Four contiguous play spaces may pay $10 and three contiguous play spaces may pay $5 in the first (yellow) game grid, for example. Additionally, for instance, three contiguous play spaces in the fourth (red) game grid may produce a higher prize ($500, for instance) than four contiguous play spaces in the second (blue) game grid ($40, for instance). If all of the jackpot spaces comprise revealed play spaces, a jackpot prize may be awarded according to the predetermined paytable. Any prize-winning ticket (according to a verification code) is then reverified by processing the ticket through a computer terminal comprised of at least a ticket input device and a computer processor at a lottery agent location or other suitable locations.

A third preferred embodiment of the present invention discloses an electronic ticket and method of conducting a game that provides an electronic lottery-type ticket displayed on an electronic device that comprises at least a monitor screen, at least an electronic processor, and at least one physical input device, that comprises: a) providing at least two game grids on the ticket, each game grid comprising a predetermined amount of columns and a predetermined amount of rows; b) designating each area of each game grid formed by the intersection of a column and a row as a play space; c) designating at least one play space of each game grid as jackpot space(s), wherein the jackpot space(s) in any one game grid cannot by themselves constitute a win and wherein all of the jackpot spaces collectively may determine a win; d) marking all of the play spaces in each separate game grid with a marking symbol from a predetermined first set of marking symbols; e) covering each play space with a removable layer; f) providing a second marking symbol from a predetermined second set of unique marking symbols for each of the play spaces; h) providing an array of marking symbols from the predetermined second set of unique marking symbols as player symbols; i) concealing each player symbol with an opaque removable layer; j) revealing each player symbol by removing the opaque layer concealing the player symbols; k) removing the removable layer over each play space comprising a marking symbol from the second set of marking symbols that matches a player symbol to reveal a play space; l) determining if any revealed play spaces are aligned at least horizontally or vertically to comprise at least one entire column and/or row in any of the game grids; m) determining if any revealed said aligned play spaces comprise like marking symbols from the first predetermined set of marking symbols; n) determining if play spaces are revealed in all of the jackpot spaces; o) providing a first predetermined paytable at least based on an entire column and/or row comprising like revealed marking symbols from the first predetermined set of marking symbols; p) providing a second predetermined paytable at least based on revealing all of the jackpot spaces; and q) providing any prizes according to the predetermined paytables. The layers may be either transparent or opaque, and the player may "scratch off" any transparent or opaque layers by utilizing an input device such as a touchscreen, mouse, button or similar tool. Alternately, the "scratch off" process may be provided by the processor.

Reference to the Figures will assist in further understanding of the practice of the present invention.

FIG. 1A illustrates the first preferred embodiment of the present invention, providing the elements of present invention that afford the specific gameplay thereof. A physical lottery instant game ticket 2 is provided, wherein the elements shown are printed on the base card of the ticket. A game ticket name 4 and a price point of the ticket ($5) 6 are shown. A game area 8 comprising a first game grid 10 providing nine play spaces marked by a diagonal brick pattern, a second game grid 12 providing nine play spaces marked by a dot pattern, a third game grid 14 providing nine play spaces marked by a checkerboard pattern, and a fourth game grid 16 providing nine play spaces marked by a striped pattern is shown. A jackpot area comprising four jackpot spaces 18 illustrated by a white outline and comprising one play area of each game grid is shown. An area for twelve player numbers ("YOUR NUMBERS") 20, a prize legend 22 and "How to Play" gameplay instructions 24 are provided.

Figure 1B:
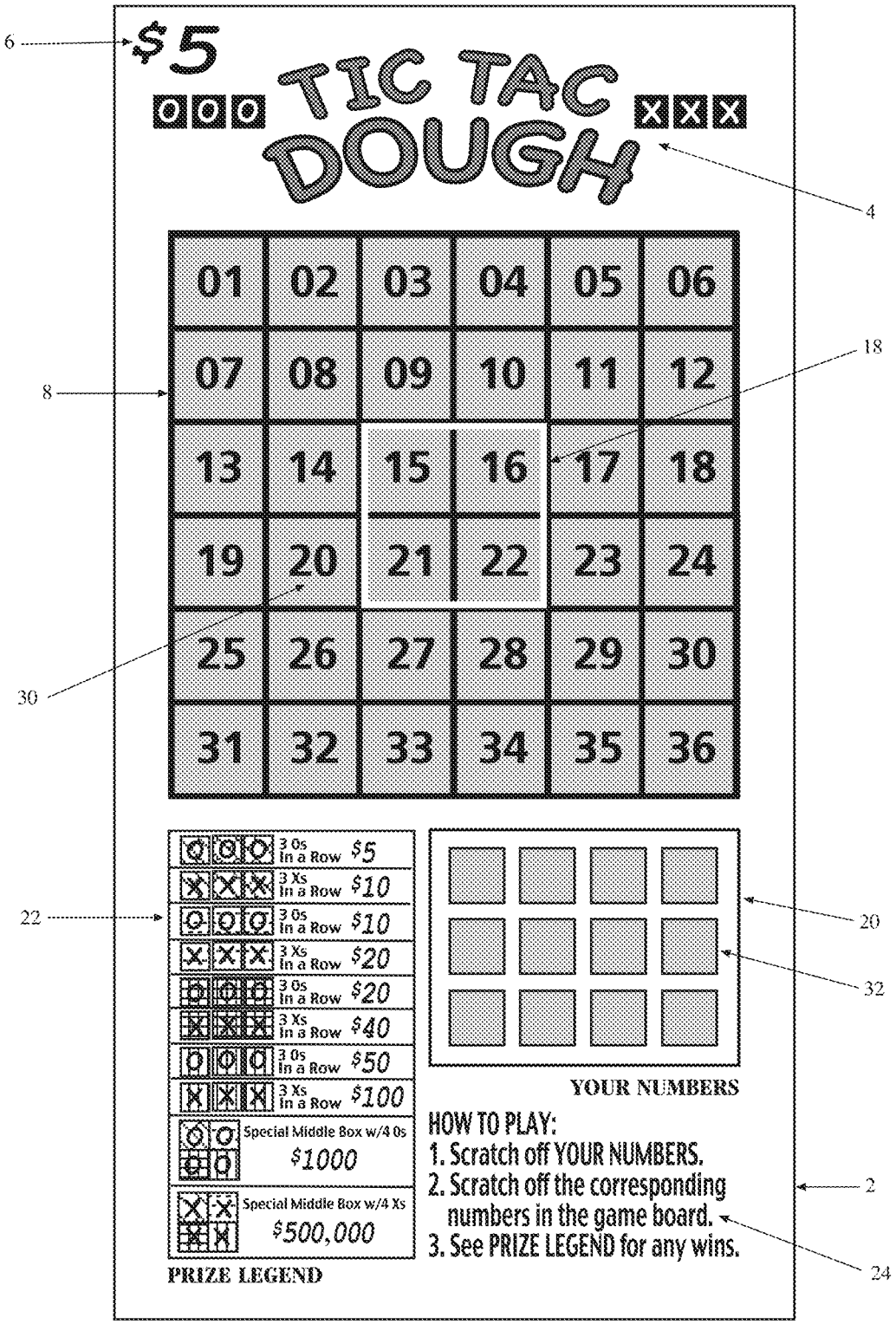
FIG. 1B refers to FIG. 1A and shows a first instant scratch ticket with play symbols and player symbols covered by removable opaque film.

FIG. 1B shows the elements of FIG. 1A wherein the play spaces within the game area 8 are concealed by an opaque removable film 30 and labeled from 1 through 36. Twelve player numbers (not shown) from the set of numbers 1 through 36 have been chosen and printed on the card under an opaque removable film 32.

Figure 1C:
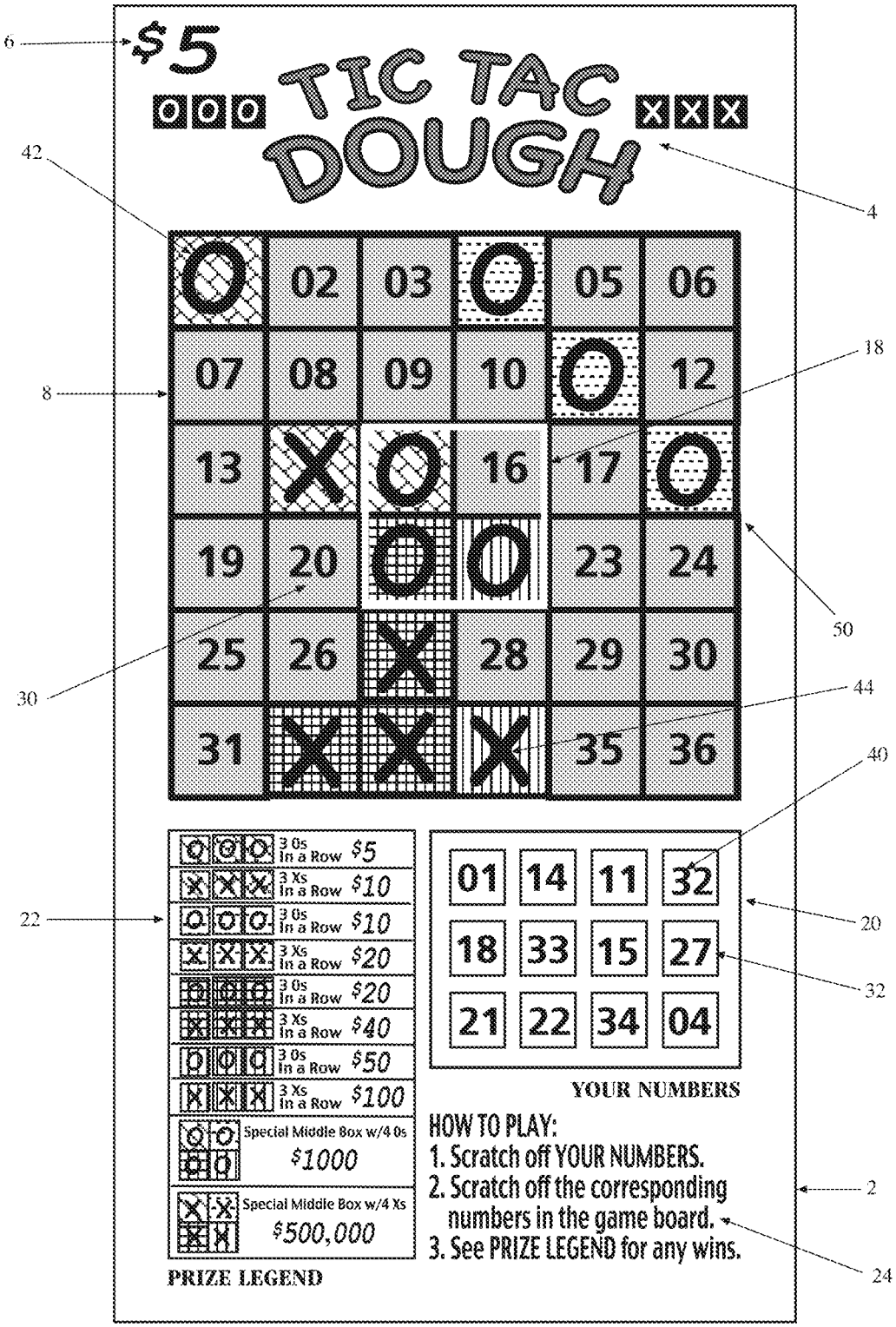
FIG. 1C refers to FIG. 1B and shows the play symbols and player symbols being revealed by scratching off the opaque film covering each element to reveal a final regular winning result.

FIG. 1C shows the elements of FIG. 1B for a first ticket wherein the player, according to the gameplay instructions 24, has removed or "scratched off" the opaque film 32 concealing the "YOUR NUMBERS" boxed area 20, revealing twelve numbers (01, 14, 11, 32, 18, 33, 15, 27, 21, 22, 34 and 04) 40. Corresponding numbers in the game area have been removed, displaying either an "O" symbol 42 or an "X" symbol 44 in the revealed play spaces. A diagonal line 50 comprising three "O" symbols in the second game grid comprises a regular win of $10 according to the prize legend 22.

Figure 1D:
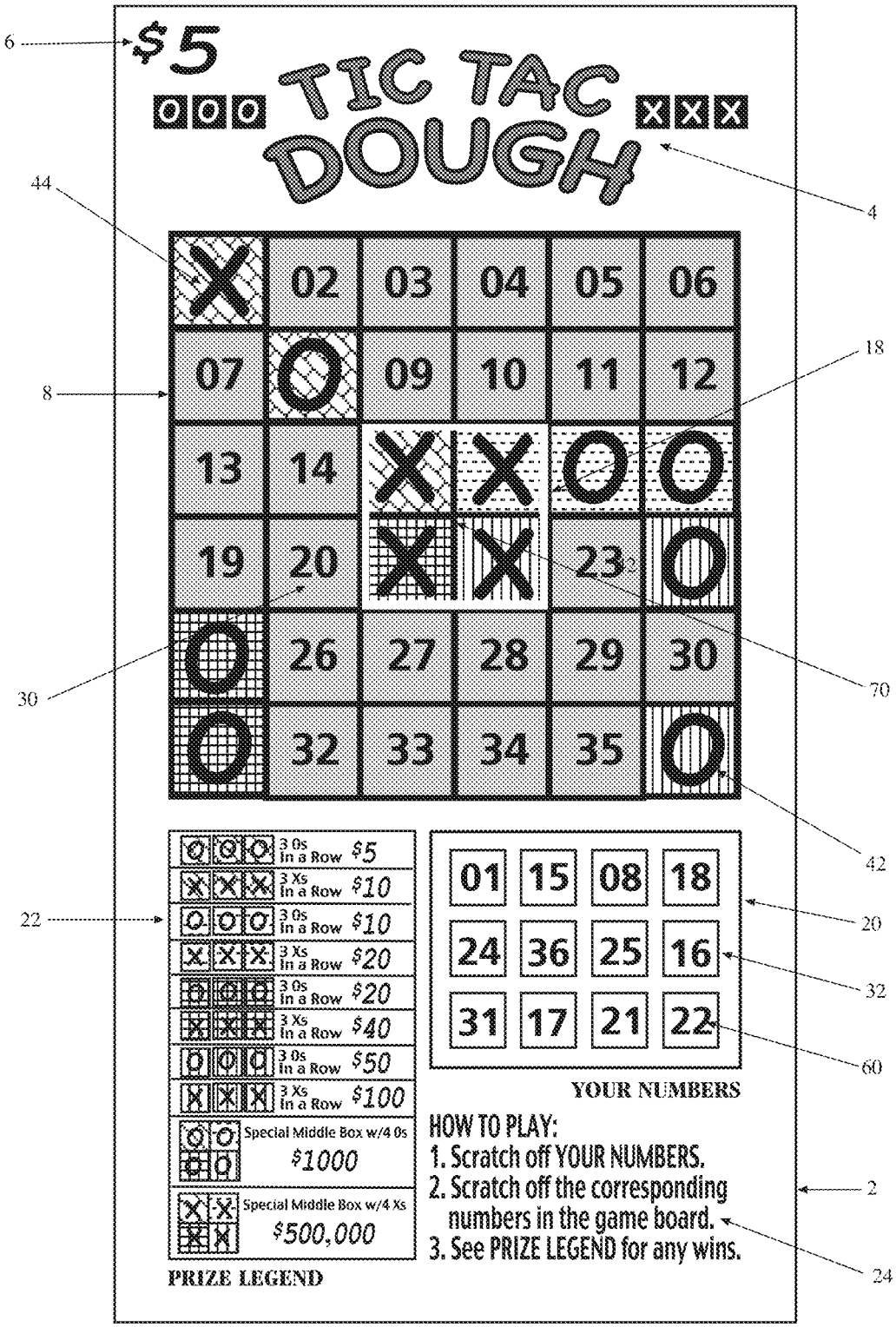
FIG. 1D shows a second instant scratch ticket as described in FIG. 1B, showing the play symbols and player symbols being revealed by scratching off the opaque film covering each element, and revealing a final jackpot winning result.

FIG. 1D shows the game elements of FIG. 1B for a second ticket wherein the player, according to the gameplay instructions 24, has removed or "scratched off" the opaque film 32 concealing the "YOUR NUMBERS" boxed area 20, revealing twelve numbers (01, 15, 08, 18, 24, 36, 25, 16, 31, 17, 21, 22) 60. Corresponding numbers in the game area have been removed, displaying either an "O" symbol 42 or an "X" symbol 44 in the revealed play spaces. Four "X" symbols 70 in the jackpot area (comprising all of the jackpot spaces) comprises a maxi jackpot win of $500,000 according to the prize legend 22.

Figure 2:
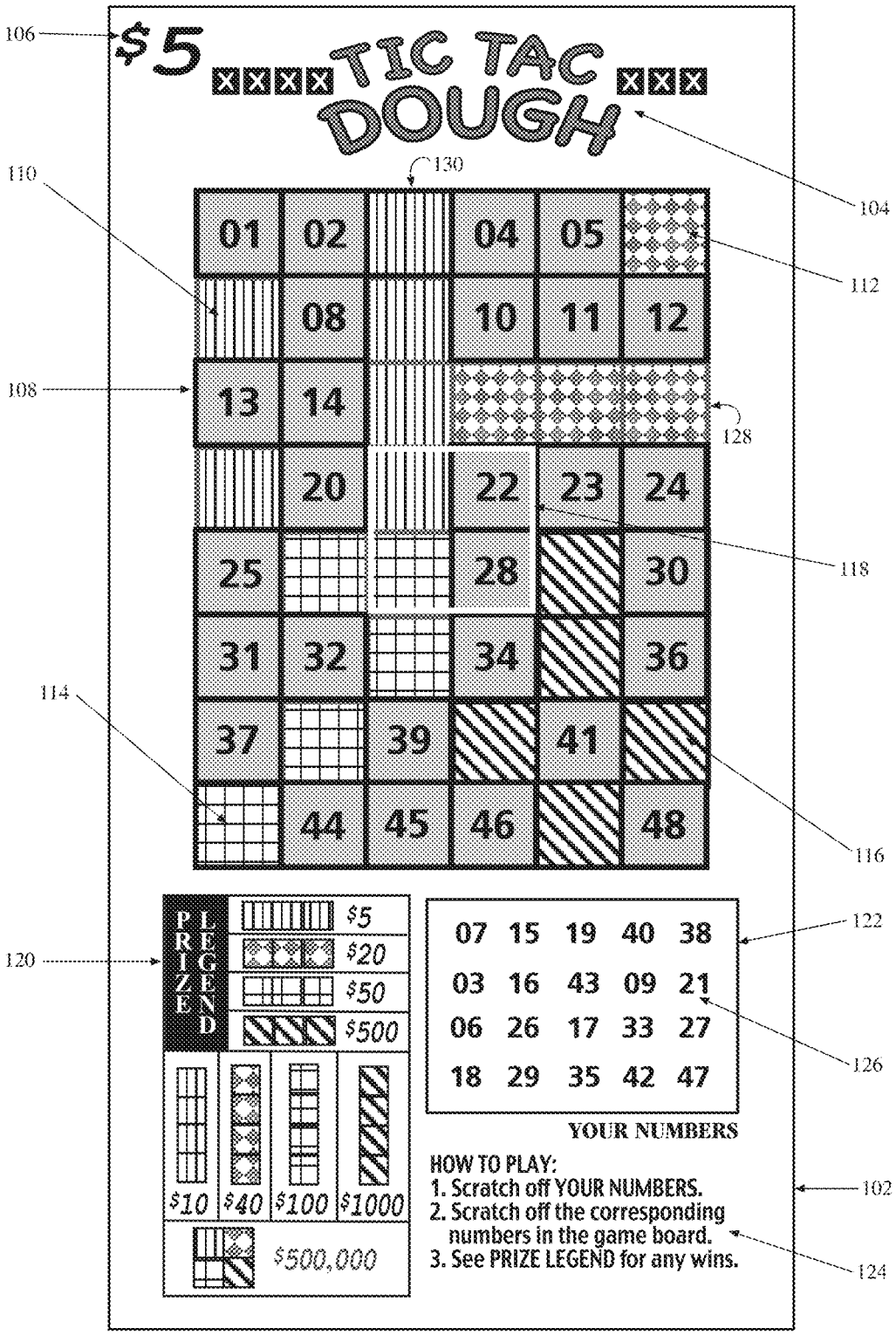
FIG. 2 shows the game elements and final results for a game utilizing the game technology described in a second preferred embodiment of the present invention herein.

FIG. 2 illustrates the second preferred embodiment of the present invention, providing the elements of present invention that afford the specific gameplay thereof. A physical lottery instant game ticket 102 is provided, comprising a game ticket name 104 and a price point of the ticket ($5) 106. Each game grid (110, 112, 114 and 116) comprises three columns by four rows, providing twelve play spaces each. A game area 108 comprising a first game grid 110 providing twelve play spaces marked by a vertical striped pattern, a second game grid 112 providing twelve play spaces marked by a diamond pattern, a third game grid 114 providing twelve play spaces marked by a checkerboard pattern, and a fourth game grid 116 providing twelve play spaces marked by a diagonal striped pattern is shown. A jackpot area comprising four jackpot spaces 118 illustrated by a white outline and comprising one play area of each game grid is shown. An area for twenty player numbers ("YOUR NUMBERS") 122, a prize legend 120 and "How to Play" gameplay instructions 124 are provided. As in FIG. 1B, the play spaces within the game area 108 have been concealed by an opaque removable film and are herein labeled from 1 through 48. Twenty player numbers 126 (07, 15, 19, 40, 38, 03, 16, 43, 09, 21, 06, 26, 17, 33, 27, 18, 29, 35, 42 and 47) from the set of numbers 1 through 48 have been revealed by removing an opaque removable film (not shown), and corresponding numbers in the game area 108 have been removed to reveal play spaces. Three play spaces 128 comprising an entire row in the second game grid affords a win of $20 according to the prize legend 120. Four play spaces 130 comprising an entire column in the first game grid affords a win of $10 according to the prize legend 120.

Although specific examples and specific win tables have been provided in this discussion, these specifics are intended to be only support for the generic concepts of the invention and are not intended to be absolute limits in the scope of the technology discussed.

What is claimed:

1. A method of conducting a lottery instant scratch ticket game that comprises the steps of:

a) providing a plurality of physical scratch tickets;

b) providing at least two game grids on each ticket, each game grid comprising a predetermined amount of columns and the same predetermined amount of rows;

c) designating each area of each game grid formed by the intersection of a column and a row as a play space;

d) designating at least one play space of each game grid as jackpot space(s), wherein the jackpot space(s) in any one game grid cannot by themselves constitute a win and wherein all of the jackpot spaces collectively may determine a win;

e) providing a predetermined set of play symbols comprising at least two distinct symbols having differing values in any one game grid;

f) distributing an array of play symbols in the play spaces in each game grid;

g) concealing each play space with an opaque removable film;

h) providing a unique marking symbol for each of the play spaces from a predetermined set of unique marking symbols;

i) providing an array of player symbols from the predetermined set of unique marking symbols;

j) concealing each player symbol with an opaque removable film;

k) revealing each player symbol by removing the opaque film concealing the player symbols;

l) removing the opaque film over each play space that is associated with each marking symbol that matches a player symbol to reveal a play symbol;

m) determining if like revealed play symbols are aligned horizontally, vertically or diagonally to comprise at least one entire column, row and/or diagonal line in any of the game grids;

n) determining if like play symbols are revealed in all of the jackpot spaces;

o) providing a first predetermined paytable based on each entire column, row and/or diagonal line that reveals like play symbols and its associated game grid;

p) providing a second predetermined paytable based on like play symbols that are revealed in all of the jackpot spaces; and q) providing any prizes according to the predetermined paytables.

2. The method of claim 1 wherein each game grid comprises three columns by three rows and provides nine play spaces.

3. The method of claim 2 wherein four game grids are adjoined in a 2×2 format.

4. The method of claim 3 wherein the top left game grid is designated as a first game grid, the top right game grid is designated as a second game grid, the bottom left game grid is designated as a third game grid, and the bottom right game grid is designated as a fourth game grid.

5. The method of claim 4 wherein the lower right play space in the first game grid, the lower left play space in the second game grid, the upper right play space in the third game grid, and the upper left play space in the fourth game grid comprise the jackpot spaces.

6. The method of claim 1 wherein the set of play symbols comprises "X" symbols and "O" symbols.

7. The method of claim 1 wherein the provided prizes differ for each of the game grids.

8. A method of conducting a lottery instant scratch ticket game that comprises the steps of:

a) providing a plurality of physical scratch tickets;

b) providing at least two game grids on each ticket, each game grid comprising a predetermined amount of columns and a differing predetermined amount of rows;

c) designating each area of each game grid formed by the intersection of a column and a row as a play space;

d) designating at least one play space of each game grid as jackpot space(s), wherein the jackpot space(s) in any one game grid cannot by themselves constitute a win and wherein all of the jackpot spaces collectively may determine a win;

e) providing all of the play spaces in each separate game grid with like play symbols from a predetermined set of play symbols, wherein the play symbols for each separate grid differ from one another;

f) covering each play space with a removable film;

g) providing a unique marking symbol from a predetermined set of marking symbols for each of the play spaces;

h) providing an array of marking symbols from the predetermined set of marking symbols as player symbols;

i) concealing each player symbol with an opaque removable film;

j) revealing each player symbol by removing the opaque film concealing the player symbols;

k) removing the removable film over each play space comprising each marking symbol that matches a player symbol to reveal a play symbol;

l) determining if like said revealed play symbols are aligned horizontally or vertically to comprise at least one entire column and/or row in any of the game grids;

m) determining if said play symbols are revealed in all of the jackpot spaces;

n) providing a predetermined paytable based on each entire column and/or row comprising revealed play symbols and its associated game grid;

o) providing a predetermined paytable based on revealing play symbols in all of the jackpot spaces; and p) providing any prizes according to the predetermined paytables.

9. The method of claim 8 wherein each game grid comprises three columns by four rows and provides twelve play spaces.

10. The method of claim 9 wherein four game grids are adjoined in a vertically-disposed 2×2 format.

11. The method of claim 10 wherein the top left game grid is designated as a first game grid, the top right game grid is designated as a second game grid, the bottom left game grid is designated as a third game grid, and the bottom right game grid is designated as a fourth game grid.

12. The method of claim 11 wherein the lower right play space in the first game grid, the lower left play space in the second game grid, the upper right play space in the third game grid, and the upper left play space in the fourth game grid comprise the jackpot spaces.

13. The method of claim 9 wherein the play symbols comprises colors, patterns, icons and the like.

14. The method of claim 9 wherein the predetermined set of marking symbols comprises numbers or letters.

15. The method of claim 14 wherein the marking symbols from the predetermined set of marking symbols are provided within the play spaces and covered with a removable transparent film.

16. The method of claim 14 wherein the marking symbols from the predetermined set of marking symbols are provided on top of a removable opaque film over each play space.

17. The method of claim 9 wherein the provided prizes differ for each of the game grids.

18. A method of conducting a game that provides an electronic lottery-type ticket displayed on an electronic device that comprises at least a monitor screen, at least an electronic processor, and at least one physical input device, that comprises the steps of:

a) providing at least two game grids on the ticket, each game grid comprising a predetermined amount of columns and a predetermined amount of rows;

b) designating each area of each game grid formed by the intersection of a column and a row as a play space;

c) designating at least one play space of each game grid as jackpot space(s), wherein the jackpot space(s) in any one game grid cannot by themselves constitute a win and wherein all of the jackpot spaces collectively may determine a win;

d) marking all of the play spaces in each separate game grid with a marking symbol from a predetermined first set of marking symbols;

e) covering each play space with a removable layer;

f) providing a unique marking symbol from a predetermined second set of unique marking symbols for each of the play spaces;

h) providing an array of player symbols from the predetermined second set of unique marking symbols;

i) concealing each player symbol with an opaque removable layer;

j) revealing each player symbol by removing the opaque layer concealing the player symbols;

k) removing the removable layer over each play space comprising a marking symbol from the second set of marking symbols that matches a player symbol to reveal a play space;

l) determining if any revealed play spaces are at least aligned horizontally or vertically to comprise at least one entire column or row in any of the game grids;

m) determining if any revealed said aligned play spaces comprise like marking symbols from the first predetermined set of marking symbols;

n) determining if play spaces are revealed in all of the jackpot spaces;

o) providing a first predetermined paytable at least based on an entire column and/or row comprising like revealed marking symbols from the first predetermined set of marking symbols;

p) providing a second predetermined paytable at least based on revealing all of the jackpot spaces; and q) providing any prizes according to the predetermined paytables.

19. The method of claim 18 wherein the removable layers are removed by the player using an input device.

20. The method of claim 18 wherein the removable layers are removed by the processor.

* * * * *